US006990889B2

(12) United States Patent
Below

(10) Patent No.: US 6,990,889 B2
(45) Date of Patent: Jan. 31, 2006

(54) SWASH PLATE DRIVE SYSTEM

(75) Inventor: John Below, Oakland, CA (US)

(73) Assignee: Rix Industries, Benicia, CA (US)

( * ) Notice: Subject to any disclaimer, the term of this patent is extended or adjusted under 35 U.S.C. 154(b) by 0 days.

(21) Appl. No.: 10/736,931

(22) Filed: Dec. 16, 2003

(65) Prior Publication Data

US 2005/0126389 A1 Jun. 16, 2005

(51) Int. Cl.
*F01B 3/00* (2006.01)

(52) U.S. Cl. ..... 92/71; 92/499

(58) Field of Classification Search ..... 92/71; 91/499; 417/269

See application file for complete search history.

(56) References Cited

U.S. PATENT DOCUMENTS

| | | | | |
|---|---|---|---|---|
| 2,611,318 | A * | 9/1952 | Wahlmark | 417/272 |
| 3,071,014 | A * | 1/1963 | Gardner, Jr. | 74/60 |
| 5,184,536 | A * | 2/1993 | Arai | 91/505 |
| 6,283,009 | B1 * | 9/2001 | Hayashi et al. | 92/71 |
| 6,446,540 | B1 * | 9/2002 | Ota et al. | 92/71 |

* cited by examiner

*Primary Examiner*—Edward K. Look
*Assistant Examiner*—Devin Hanan
(74) *Attorney, Agent, or Firm*—Thomas R. Lampe

(57) ABSTRACT

A swash plate disposed in a housing is a ball bearing assembly. The outer race of the ball bearing assembly is free to move relative to a swash plate drive shaft and also relative to reciprocating members driven by the swash plate and mounted for axial movement.

7 Claims, 4 Drawing Sheets

SWASH PLATE DRIVE SYSTEM

TECHNICAL FIELD

This invention relates to swash plate drive apparatus. The invention is applicable, for example, for use in compressors. However, the invention can be utilized in and with equipment other than compressors.

BACKGROUND OF THE INVENTION

The use of swash plates in compressors and other types of equipment is well known. Swash plates convert rotary motion into reciprocating motion imparted to pistons or other members.

In conventional swash plate arrangements, it is standard practice to provide structure preventing rotation of the swash plate and provide mechanical linkages, such as connector rods, between the non-rotating swash plate and pistons or other reciprocating members actuated thereby. Such arrangements produce wear and metal fatigue in the swash plate and associated structure.

DISCLOSURE OF INVENTION

The present invention relates to a unique approach for converting rotary motion into reciprocating motion. The arrangement eliminates the need for an anti-rotation means for the swash plate, allowing different locations on the contact surface of the swash plate to be engaged during operation. This greatly reduces wear and metal fatigue at the contact points. Also, the apparatus of the present invention eliminates the need for a connecting rod or other interconnecting structure between the swash plate and reciprocating members at fixed locations thereon.

The invention relates to a combination of structural elements including a housing defining a housing interior.

A swash plate drive shaft is disposed within the housing interior and rotatably mounted relative to the housing about an axis of rotation.

A swash plate is mounted on the swash plate drive shaft and angularly disposed relative to the axis of rotation, the swash plate being located in the housing interior. The swash plate has an outer swash plate portion surrounding the swash plate drive shaft and generally freely rotatably moveable about and relative to the swash plate drive shaft. The outer swash plate portion has a contact surface.

The apparatus also includes a plurality of spaced reciprocating members mounted for reciprocatable axial movement relative to the housing and engaging the contact surface of the outer swash plate portion. The locations of contact between the contact surface and the reciprocating members changes when the outer swash plate portion rotates about the swash plate drive shaft.

The swash plate comprises a ball bearing assembly, the outer swash plate portion comprising an outer race of the ball bearing assembly.

Other features, advantages and objects of the present invention will become apparent with reference to the following description and accompanying drawings.

BEST MODE FOR CARRYING OUT THE INVENTION

Figure 1:
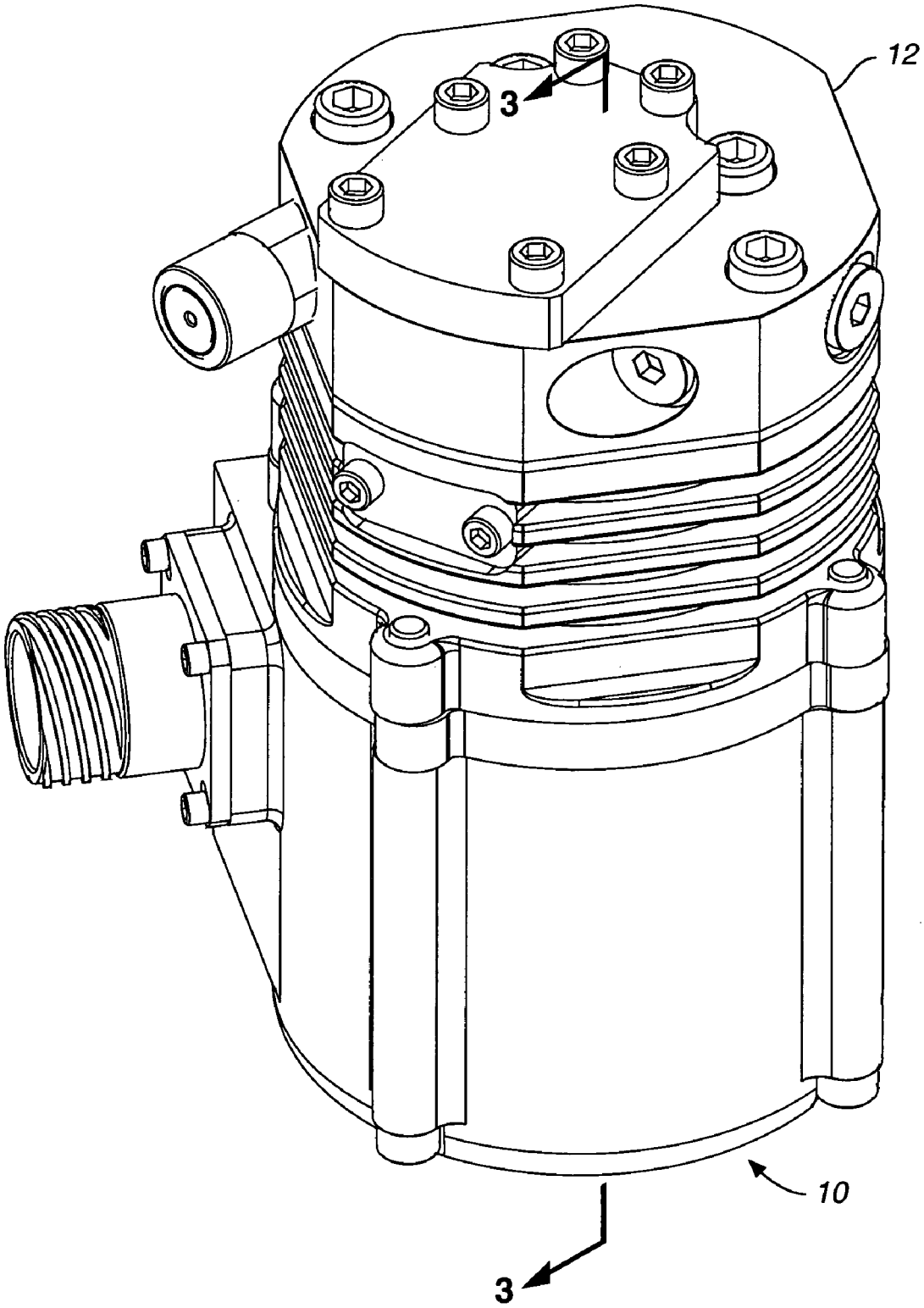
FIG. 1 is a perspective view of an air compressor incorporating the present invention.
Figure 2:
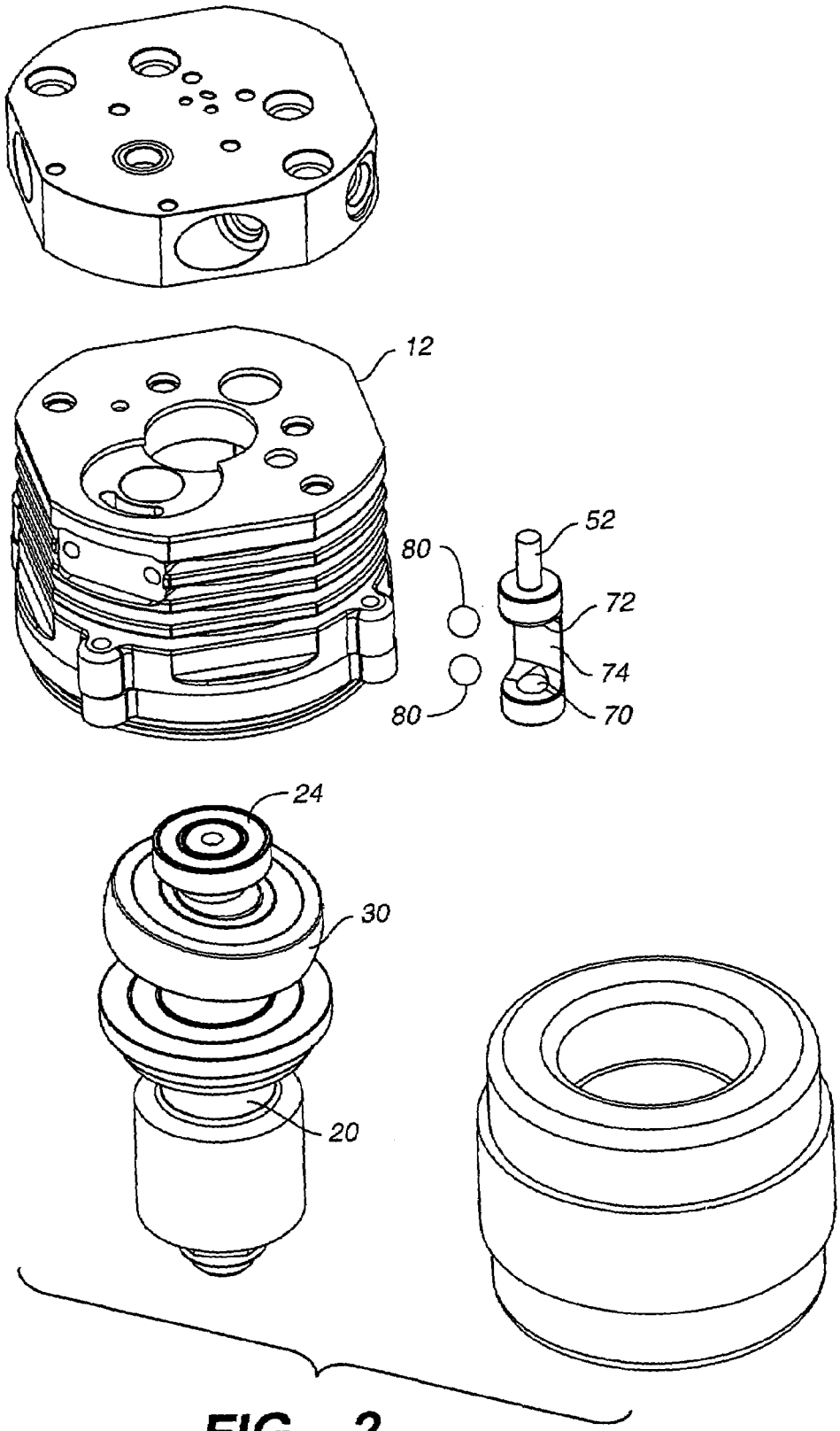
FIG. 2 is an exploded, perspective view illustrating selected components of the compressor, including a housing, a swash plate drive shaft, a swash plate and one reciprocating member to be actuated by the swash plate.

Referring now to the drawings, an air compressor 10 incorporating the present invention is illustrated, the compressor having a housing 12 defining a housing interior 14.

Figure 4:
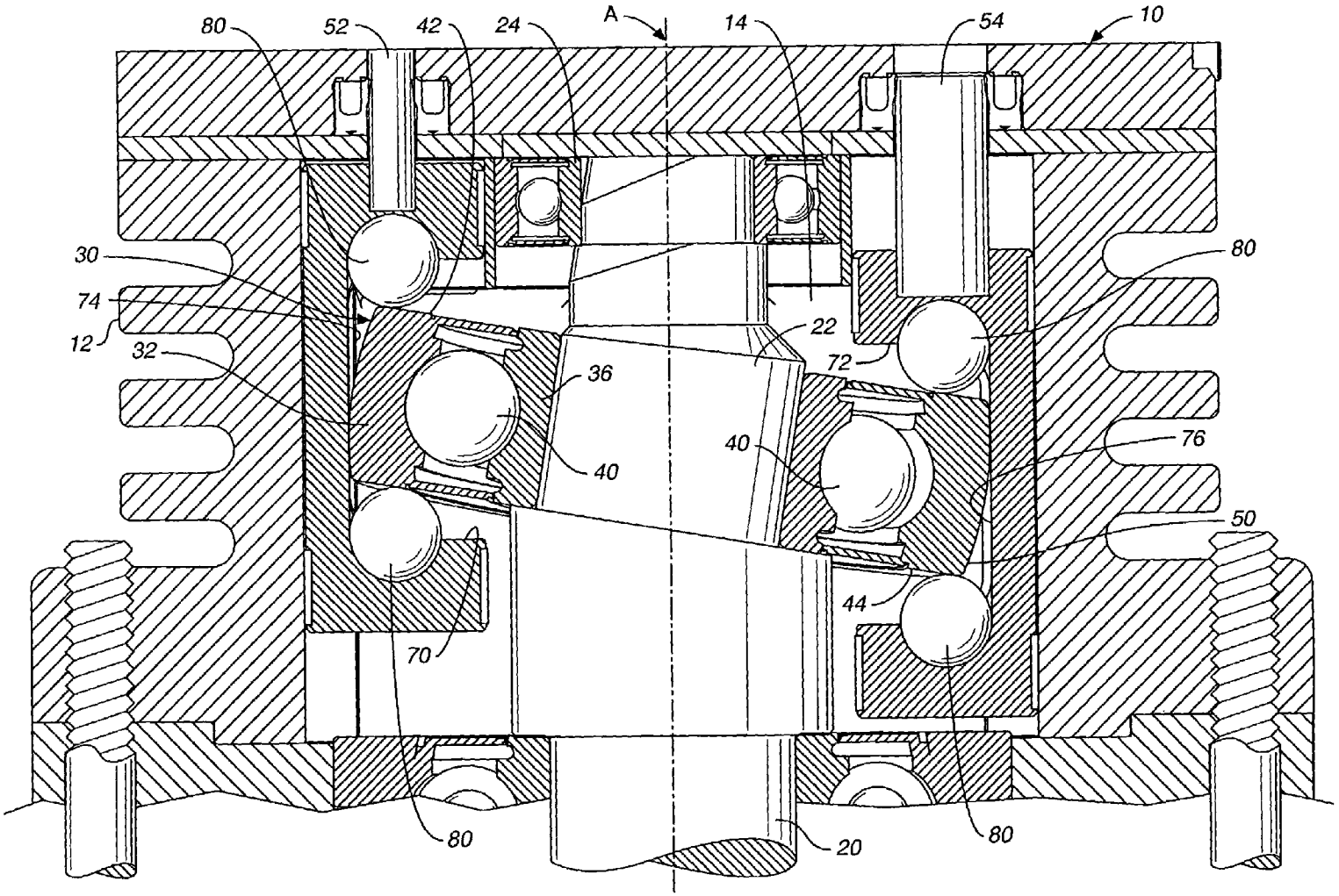
FIG. 4 is a greatly enlarged, cross-sectional view illustrating an upper portion of the compressor housing, a swash plate drive shaft, a swash plate constructed in accordance with the teachings of the present invention mounted on the swash plate drive shaft and reciprocating members mounted for axial reciprocatable movement relative to the housing and engaged by the swash plate.

A swash plate drive shaft 20 is disposed in the housing interior and rotatably mounted relative to the housing by a motor of the compressor about an axis of rotation A (see FIG. 4). A portion 22 of the drive shaft is canted, i.e. angularly oriented relative to axis of rotation A. Bearings such as ball bearing 24 are disposed about the drive shaft to rotatably support the drive shaft relative to the compressor housing.

A swash plate 30 in the form of a ball bearing assembly is mounted on the swash plate drive shaft and angularly disposed relative to axis of rotation A, the swash plate being located in housing interior 14.

The outer swash plate portion of the ball bearing assembly comprising the swash plate is in the form of an outer ball bearing assembly race 32. The ball bearing assembly further includes an inner race 36 and ball bearings 40 disposed between the inner race and the outer race. The inner race is fixedly secured to drive shaft portion 22 and the outer race 32 is freely rotatably moveable about and relative to the swash plate drive shaft 20.

The outer race or swash plate portion 32 has two substantially planar contact surfaces 42, 44 which are substantially parallel to one another.

The outer race 32 also has a convexly curved outer peripheral wall 50 adjacent to and extending between contact surfaces 42, 44. The convexly curved outer peripheral wall 50 comprises a segment of an imaginary sphere.

The illustrated compressor also includes spaced reciprocating members. Two such members 52, 54 are illustrated. The reciprocating members are in the form of pistons, the topmost portions thereof (as viewed in the drawings) being of different diameters. In swash plate compressors per se, the feature of pistons having different diameters is commonplace and conventional, the pistons slidably positioned for reciprocatable movement in bores of corresponding size formed in the compressor housing. Typically, there are three or more such pistons.

Typically, pistons or other reciprocating members associated with a conventional swash plate are attached to the swash plate by connector rods or other mechanical linkages and the swash plate is fixed against rotatable movement. As will now be seen, the arrangement of the present invention is substantially different and does not have the drawbacks and disadvantages discussed above found in conventional arrangements.

In the present invention, the reciprocating members have cavities 70, 72 receiving the outer race. These cavities are respectively defined by concavely curved cavity walls 74, 76 of the reciprocating members or pistons. The concavely curved cavity walls 74, 76 and the convexly curved outer peripheral wall 50 of the outer race conform in shape. The peripheral wall 50 engages the cavity walls 74, 76 during all stages of the operation of the apparatus. The outer race 32 has a central diametric axis and the axis of rotation A of the swash plate drive shaft is intersected by the central diametric axis of the outer race substantially at the center of the imaginary sphere of which the convexly curved outer peripheral wall of the outer race comprises a segment.

In the arrangement illustrated, the substantially parallel, substantially planar contact surfaces 42, 44 are engaged by ball bearings 80 of the reciprocating members projecting into cavities 70, 72 and engaging the two substantially planar contact surfaces.

Figure 3B:
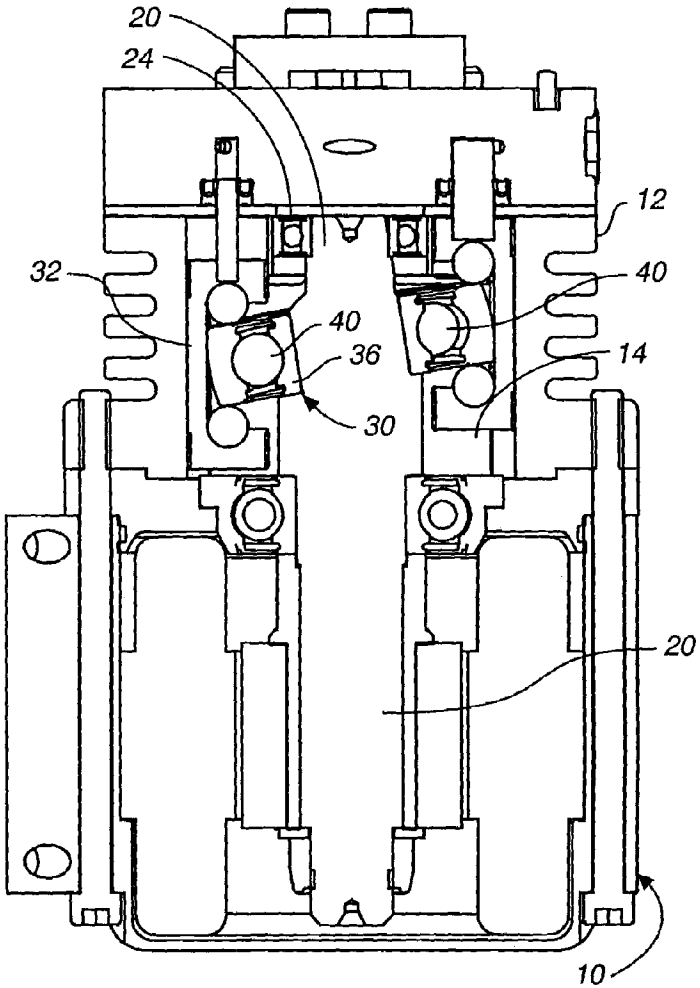
FIGS. 3A and 3B are sectional views taken along the line 3—3 in FIG. 1 and illustrating selected components of the invention in alternative relative positions assumed thereby during operation of the compressor.
Figure 3A:
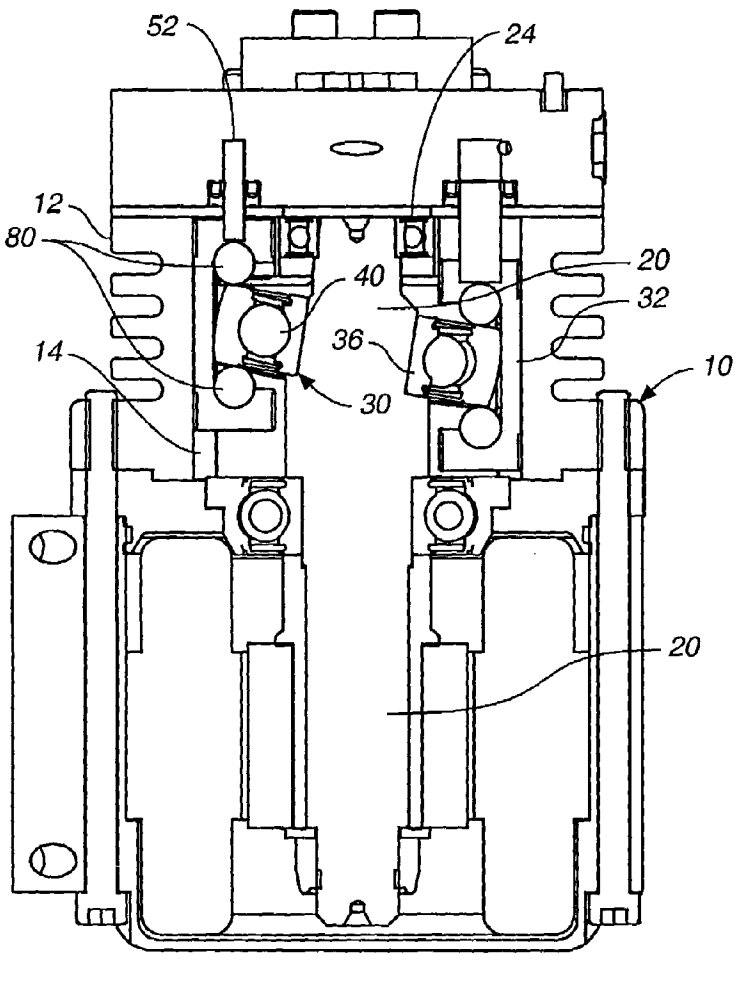

As is the case with conventional swash plate arrangements, rotation of the swash plate drive shaft will cause the swash plate to wobble, as illustrated, for example, in FIGS. 3A, 3B. This movement will be translated into reciprocatable axial movement of the pistons relative to the housing.

As compared to prior art arrangements, however, the outer race or outer portion of the ball bearing assembly 30 is free to rotate and in fact does so, continuously placing different locations on the contact surfaces of the swash plate into engagement with ball bearings 80, greatly reducing wear and metal fatigue at the contact points. Furthermore, the unique interconnection between the swash plate and the reciprocating members eliminates the need for a connecting rod between the swash plate and reciprocating members at fixed locations thereon and the associated connector rod bearings.

The invention claimed is:

1. In combination:

a housing defining a housing interior;

a swash plate drive shaft disposed in said housing interior and rotatably mounted relative to said housing about an axis of rotation;

a swash plate mounted on said swash plate drive shaft angularly disposed relative to said axis of rotation and located in said housing interior, said swash plate having an outer swash plate portion surrounding said swash plate drive shaft and generally freely rotatably moveable about and relative to said swash plate drive shaft and relative to said housing, said swash plate comprising a bearing assembly and said outer swash plate portion comprising an outer race of said bearing assembly, said outer race having spaced contact surfaces disposed in opposition to one another; and a plurality of spaced reciprocating members mounted for reciprocatable axial movement relative to said housing, each of said reciprocating members defining a cavity receiving the outer race and simultaneously frictionally engaging the spaced contact surfaces of said outer race, said spaced contact surfaces upon rotation of said swash plate drive shaft exerting opposed forces on said reciprocating members causing reciprocatable axial movement of said reciprocating members but not preventing rotation of said outer race about and relative to said swash plate drive shaft and relative to said housing, whereby the locations of contact between said contact surfaces and said reciprocating members change when said outer race rotates about said swash plate drive shaft and relative to said housing to reduce wear between said reciprocating members and said outer race.

2. The combination according to claim 1 wherein said outer race has a convexly curved outer peripheral wall extending between said contact surfaces.

3. The combination according to claim 2 wherein the convexly curved outer peripheral wall of the outer race comprises a segment of an imaginary sphere.

4. In combination:

a housing defining a housing interior;

a swash plate drive shaft disposed in said housing interior and rotatably mounted relative to said housing about an axis of rotation;

a swash plate mounted on said swash plate drive shaft angularly disposed relative to said axis of rotation and located in said housing interior, said swash plate having an outer swash plate portion surrounding said swash plate drive shaft and generally freely rotatably moveable about arid relative to said swash plate drive shaft, said outer swash plate portion having a contact surface; and a plurality of spaced reciprocating members mounted for reciprocatable axial movement relative to said housing and engaging the contact surface of said outer swash plate portion, the locations of contact between said contact surface and said reciprocating members changing when said outer swash plate portion rotates about said swash plate drive shaft, said swash plate comprising a ball bearing assembly and said outer swash plate portion comprising an outer race of said ball bearing assembly having a convexly curved outer peripheral wall adjacent to said contact surface, said spaced reciprocating members having cavities receiving said outer race defined by concavely curved cavity walls engaged by the convexly curved outer peripheral wall of said outer race, the concavely curved cavity walls and the convexly curved outer peripheral wall of said outer race conforming in shape, and said outer race having two substantially planar contact surfaces spaced from one another and extending inwardly from said convexly curved outer peripheral wall, said spaced reciprocating members including ball bearings projecting into said cavities and engaging said two substantially planar contact surfaces.

5. The combination according to claim 4 wherein said two substantially planar contact surfaces are substantially parallel to one another.

6. In combination:

a housing defining a housing interior;

a swash plate drive shaft disposed in said housing interior and rotatably mounted relative to said housing about an axis of rotation;

a swash plate mounted on said swash plate drive shaft angularly disposed relative to said axis of rotation and located in said housing interior, said swash plate having an outer swash plate portion surrounding said swash plate drive shaft and generally freely rotatably moveable about and relative to said swash plate drive shaft and relative to said housing, said swash plate comprising a bearing assembly and said outer swash plate portion comprising an outer race of said bearing assembly, said outer race having a contact surface; and a plurality of spaced reciprocating members mounted for reciprocatable axial movement relative to said housing and frictionally engaging the contact surface of said outer race but not preventing rotation of said outer race about and relative to said swash plate drive shaft and relative to said housing, whereby the locations of contact between said contact surface and said reciprocating members change when said outer race rotates about said swash plate drive shaft and relative to said housing to reduce wear between said reciprocating members and said outer race, said outer race having a convexly curved outer peripheral wall adjacent to said contact surface, and said spaced reciprocating members having cavities receiving said outer race defined by concavely curved cavity walls engaged by the convexly curved outer peripheral wall of said outer race, the concavely curved cavity walls and the convexly curved outer peripheral wall of said outer race conforming in shape.

7. In combination:

a housing defining a housing interior;

a swash plate drive shaft disposed in said housing interior and rotatably mounted relative to said housing about an axis of rotation;

a swash plate mounted on said swash plate drive shaft angularly disposed relative to said axis of rotation and located in said housing interior, said swash plate having an outer swash plate portion surrounding said swash plate drive shaft and generally freely rotatably moveable about and relative to said swash plate drive shaft and relative to said housing, said swash plate comprising a bearing assembly and said outer swash plate portion comprising an outer race of said bearing assembly, said outer race having a contact surface; and a plurality of spaced reciprocating members mounted for reciprocatable axial movement relative to said housing and frictionally engaging the contact surface of said outer race but not preventing rotation of said outer race about and relative to said swash plate drive shaft and relative to said housing, whereby the locations of contact between said contact surface and said reciprocating members change when said outer race rotates about said swash plate drive shaft and relative to said housing to reduce wear between said reciprocating members and said outer race, said outer race having a convexly curved outer peripheral wall adjacent to said contact surface, the convexly curved outer peripheral wall of the outer race comprising a segment of an imaginary sphere, and said outer race having a central diametric axis, the axis of rotation of said swash plate drive shaft being intersected by the central diametric axis of said outer race substantially at the center of said imaginary sphere.

* * * * *